US009535395B2

(12) United States Patent
Shinoya et al.

(10) Patent No.: US 9,535,395 B2
(45) Date of Patent: Jan. 3, 2017

(54) PROCESS CARTRIDGE HAVING DRUM UNIT AND DEVELOPING UNIT INCLUDING AN ELECTRICAL TERMINAL

(71) Applicant: BROTHER KOGYO KABUSHIKI KAISHA, Nagoya-shi, Aichi-ken (JP)

(72) Inventors: Shota Shinoya, Nagoya (JP); Junichi Hashimoto, Toyohashi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/055,842

(22) Filed: Feb. 29, 2016

(65) Prior Publication Data

US 2016/0291536 A1 Oct. 6, 2016

(30) Foreign Application Priority Data

Mar. 31, 2015 (JP) ..... 2015-073526

(51) Int. Cl.
*G03G 15/00* (2006.01)
*G03G 21/18* (2006.01)

(52) U.S. Cl.
CPC ..... *G03G 21/1803* (2013.01); *G03G 21/1867* (2013.01)

(58) Field of Classification Search
CPC ..... G03G 21/1817; G03G 21/1821; G03G 21/1825; G03G 21/1867; G03G 21/1871
USPC ..... 399/90, 113
See application file for complete search history.

(56) References Cited

U.S. PATENT DOCUMENTS

| | | | | |
|---|---|---|---|---|
| 7,986,897 | B2 * | 7/2011 | Nishimura | G03G 21/1821 399/90 |
| 8,351,820 | B2 * | 1/2013 | Kato | G03G 21/1821 399/113 |
| 8,879,944 | B2 * | 11/2014 | Takarada et al. | G03G 21/1867 399/90 |
| 2005/0047822 | A1 | 3/2005 | Hashimoto et al. | |
| 2007/0009281 | A1 | 1/2007 | Sato et al. | |
| 2007/0009282 | A1 | 1/2007 | Sato et al. | |
| 2009/0226209 | A1 | 9/2009 | Shiraki et al. | |
| 2015/0277361 | A1 | 10/2015 | Nishiyama | |

FOREIGN PATENT DOCUMENTS

| | | |
|---|---|---|
| JP | 2005-338775 A | 12/2005 |
| JP | 2007-102152 | 4/2007 |
| JP | 2009-216802 A | 9/2009 |
| JP | 2015-197528 A | 11/2015 |

* cited by examiner

*Primary Examiner* — William J Royer
(74) *Attorney, Agent, or Firm* — Merchant & Gould P.C.

(57) ABSTRACT

A process cartridge includes: a first unit including a first side plate, a second side plate and a photosensitive drum; and a second unit including a developing member and an electrical terminal for supplying power to the developing member. The second unit is pivotally movable relative to the first unit about a pivot axis between a first position and a second position. The electrical terminal is rotatably supported by the first side plate and is positioned on the pivot axis.

23 Claims, 9 Drawing Sheets

PROCESS CARTRIDGE HAVING DRUM UNIT AND DEVELOPING UNIT INCLUDING AN ELECTRICAL TERMINAL

CROSS REFERENCE TO RELATED APPLICATION

This application claims priority from Japanese Patent Application No. 2015-073526 filed Mar. 31, 2015. The entire content of the priority application is incorporated herein by reference.

TECHNICAL FIELD

The present disclosure relates to a process cartridge that is mounted in an electrophotographic image-forming apparatus.

BACKGROUND

A conventional process cartridge may be provided with a drum unit having a photosensitive drum, and a developing unit having a developing roller. In such conventional process cartridge, the developing unit can pivotally move about a pivot axis between a position at which the developing roller contacts the photosensitive drum, and a position at which the developing roller is separated from the photosensitive drum.

SUMMARY

The above-described process cartridge may further include a contact-receiving part for receiving a developing bias from a device-side contact provided in a body of an image-forming apparatus. The contact-receiving part in the process cartridge is positioned spaced away from the pivot axis of the developing unit. Consequently, the contact-receiving part needs to move a considerable distance when the developing unit pivots, increasing a potential for wear due to friction between the contact-receiving part and the device-side contact. Wear in the contact-receiving part may degrade stability of the developing bias supplied to the developing roller.

In view of the foregoing, it is an object of the present disclosure to provide a process cartridge capable of supplying stable power to at least one of a developing roller, a supply roller, and a thickness-regulating blade.

In order to attain the above and other objects, the disclosure provides a process cartridge including a first unit and a second unit. The second unit is pivotally movable relative to the first unit about a pivot axis between a first position and a second position. The first unit includes a first side plate, a second side plate and a photosensitive drum. The second unit includes a developing member and an electrical terminal for supplying power to the developing member. The electrical terminal is rotatably supported by the first side plate and is positioned on the pivot axis.

BRIEF DESCRIPTION OF THE DRAWINGS

The particular features and advantages of the disclosure as well as other objects will become apparent from the following description taken in connection with the accompanying drawings, in which.

DETAILED DESCRIPTION

First Embodiment

Figure 1:
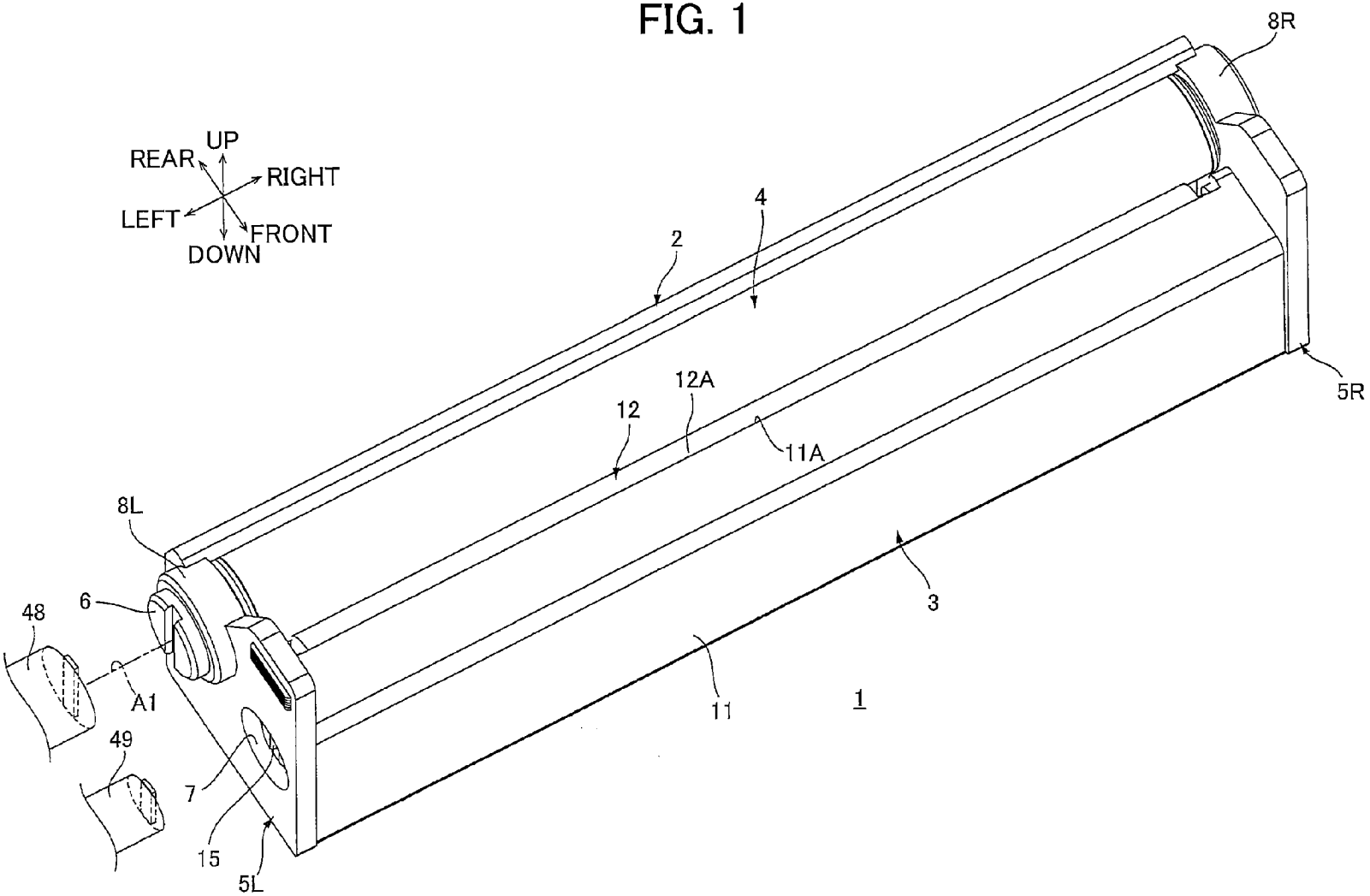
FIG. 1 is a perspective view of a process cartridge according to a first embodiment.

A process cartridge 1 according to a first embodiment will be described while referring to FIGS. 1 through 8.

Directions used in the following description will conform to directional arrows shown in the drawings.

1. Process Cartridge

As shown in FIG. 1, the process cartridge 1 has a rectangular prism-like shape that is elongated in a left-right direction. The process cartridge 1 includes a drum unit 2 as an example of a first unit, and a developing unit 3 as an example of a second unit.

(1) Drum Unit

The drum unit 2 includes a photosensitive drum 4, a right side plate 5R (as an example of a first side plate), a left side plate 5L (as an example of a second side plate), and a connecting member 10.

The photosensitive drum 4 is positioned in an upper-rear corner portion of the process cartridge 1. The photosensitive drum 4 has a cylindrical shape elongated in the left-right direction. The photosensitive drum 4 defines a rotational axis A1 oriented in the left-right direction. The photosensitive drum 4 includes a drum joint 6.

The drum joint 6 is positioned on a left end of the photosensitive drum 4. The drum joint 6 can rotate together with the photosensitive drum 4 about the rotational axis A1 of the photosensitive drum 4. The drum joint 6 has a circular column shape that is elongated in the left-right direction. When the process cartridge 1 is mounted in an image-forming apparatus 21 described later (see FIG. 8), the drum joint 6 is configured to be coupled with a body-side joint 48 provided in the image-forming apparatus 21, indicated by phantom lines in FIG. 1, and can rotate together with the body-side joint 48.

Figure 2:
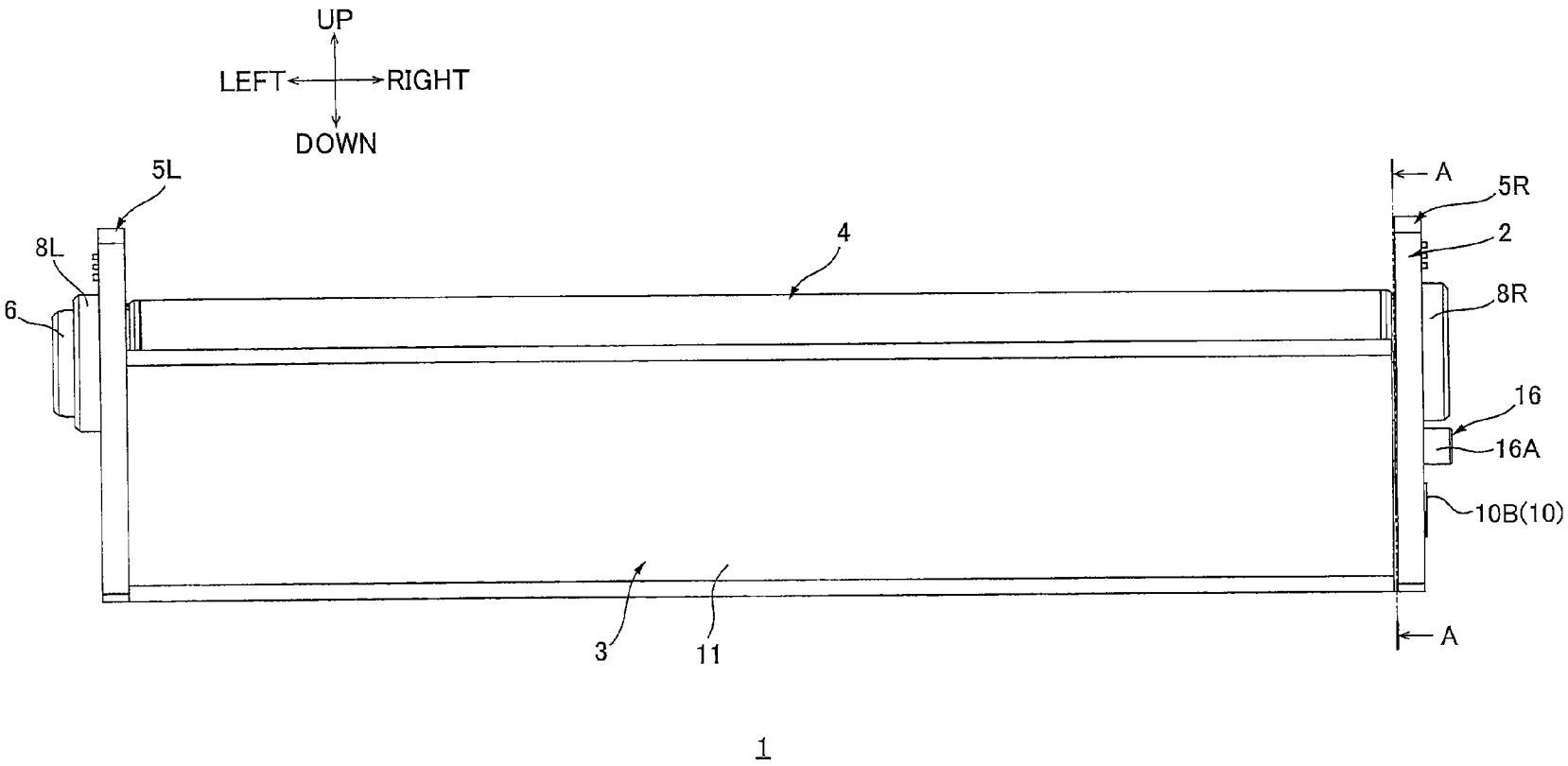
FIG. 2 is a front view of the process cartridge according to the first embodiment shown in FIG. 1.
Figure 3A:
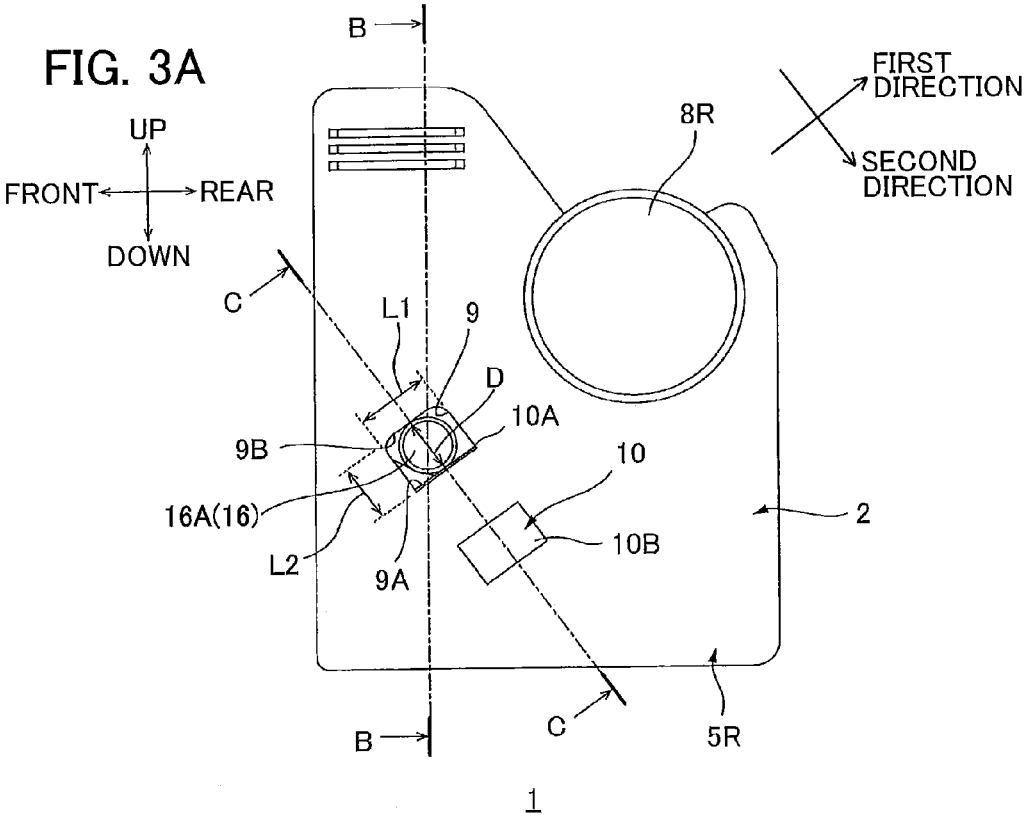
FIG. 3A is a right side view of the process cartridge according to the first embodiment shown in FIG. 1.

As shown in FIGS. 2 and 3A, the right side plate 5R is positioned on a right end portion of the process cartridge 1. The right side plate 5R is formed of an electrically insulating resin and has a generally rectangular shape in a side view that extends in front-rear and vertical directions. The right side plate 5R includes a hole 9, and a support part 8R.

The hole 9 is formed in the right side plate 5R at a position near a front edge thereof. The hole 9 penetrates the right side plate 5R in the left-right direction. Referring to FIG. 3A, the hole 9 has a rectangular shape in a side view that is elongated in a first direction extending from the lower front to the upper rear. In other words, the hole 9 has an inside dimension L1 in the first direction that is greater than an inside dimension L2 of the hole 9 in a second direction orthogonal to the first direction (i.e., a second direction extending from the upper front to the lower rear). Specifically, the hole 9 is defined by peripheral surfaces including two contact surfaces 9A and 9B opposing each other in the second direction. The contact surface 9A is a lower-rear surface defining the hole 9, while the contact surface 9B is an upper-front surface defining the hole 9.

The support part 8R is positioned in an upper-rear corner of the right side plate 5R. The support part 8R has a cylindrical shape and is elongated in the front-rear direction. In the support part 8R, a right end of the photosensitive drum 4 is rotatably fitted. Accordingly, the right side plate 5R rotatably supports the right end of the photosensitive drum 4.

Figure 7:
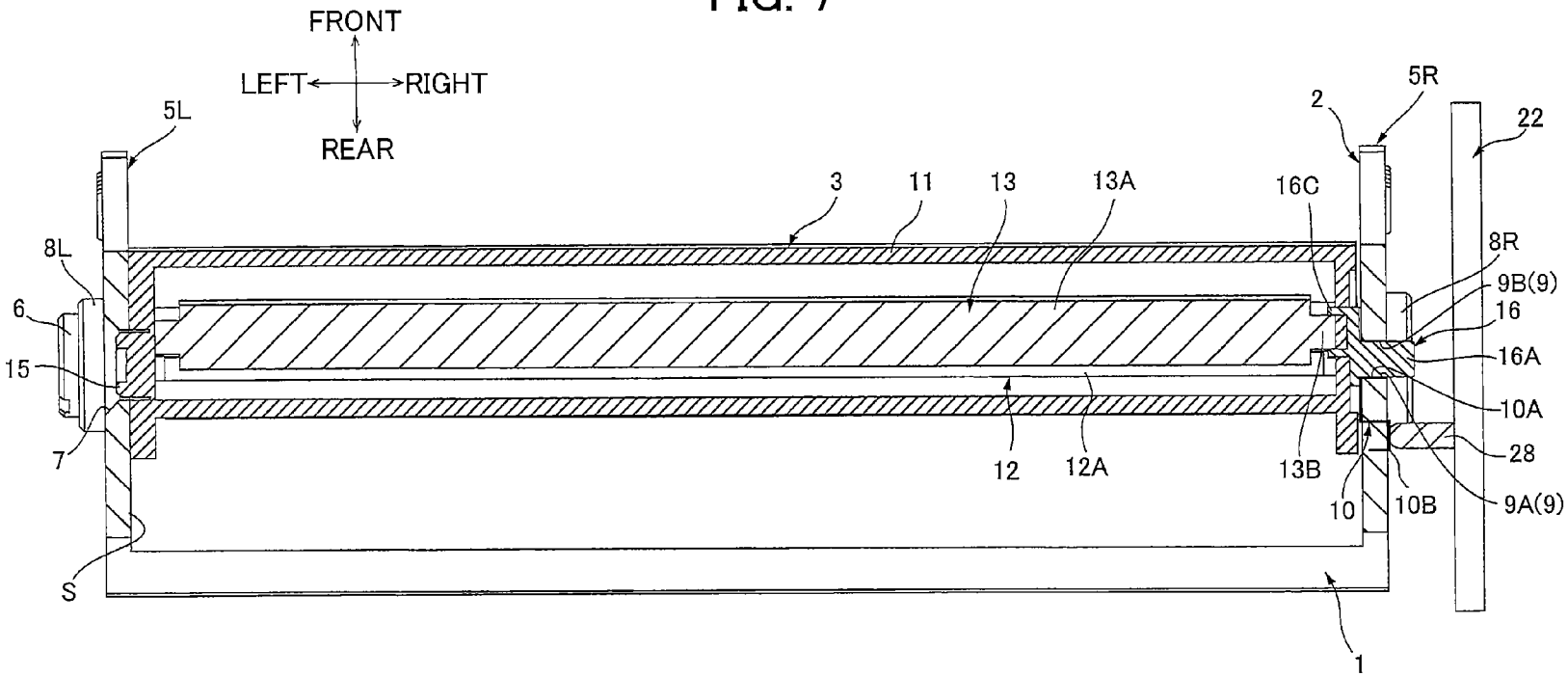
FIG. 7 is a cross-sectional view of the process cartridge of FIG. 3A taken along a plane C-C shown in FIG. 3A.

As shown in FIGS. 3A and 7, the connecting member 10 is positioned rearward and downward of the hole 9. The connecting member 10 is formed of a metal having a high electrical conductivity, such as copper. The connecting member 10 has a plate shape extending from the upper front to the lower rear. More specifically, as shown in FIG. 7, the connecting member 10 has a generally S-shaped cross-section taken along a plane C-C shown in FIG. 3A. The connecting member 10 includes a first contact part 10A as an example of a first contact, and a second contact part 10B as an example of a second contact.

The first contact part 10A constitutes an upper-front end portion of the connecting member 10. The first contact part 10A is positioned between the contact surface 9A and a supported part 16A described later. The first contact part 10A extends along the contact surface 9A and is exposed inside the hole 9.

The second contact part 10B constitutes a lower-rear end portion of the connecting member 10. The second contact part 10B is positioned downward of and rearward of the hole 9 to be spaced away therefrom. Thus, the second contact part 10B is separated from and positioned diagonally below and rearward of the supported part 16A described later. The second contact part 10B is also positioned on a right surface of the right side plate 5R and extends along the right surface. Thus the second contact part 10B is exposed rightward of the process cartridge 1. The second contact part 10B has a rectangular shape in a side view.

Figure 3B:
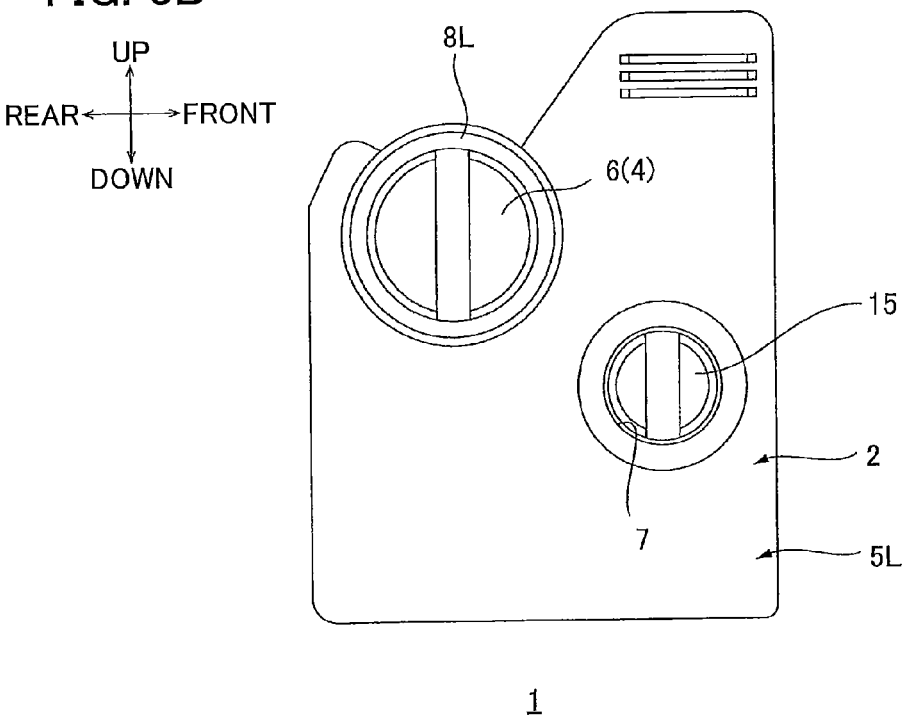
FIG. 3B is a left side view of the process cartridge according to the first embodiment shown in FIG. 1.

As shown in FIGS. 2 and 3B, the left side plate 5L is positioned on a left end portion of the process cartridge 1, i.e., on a side opposite the right side plate 5R with respect to the left-right direction. The left side plate 5L is formed of an electrically insulating resin and has a generally rectangular shape in a side view extending in the front-rear and vertical directions. The left side plate 5L includes a hole 7, and a support part 8L.

The hole 7 is formed in the left side plate 5L at a position near a front edge thereof. The hole 7 has a circular shape in a side view and penetrates the left side plate 5L in the left-right direction.

The support part 8L is positioned in an upper-rear corner portion of the left side plate 5L. The support part 8L has a cylindrical shape and is elongated in the left-right direction. The drum joint 6 is rotatably fitted into the support part 8L, whereby the left side plate 5L rotatably supports the left end of the photosensitive drum 4.

While not shown in the drawings, the drum unit 2 also includes a charger for uniformly charging a peripheral surface of the photosensitive drum 4.

(2) Developing Unit

Figure 8:
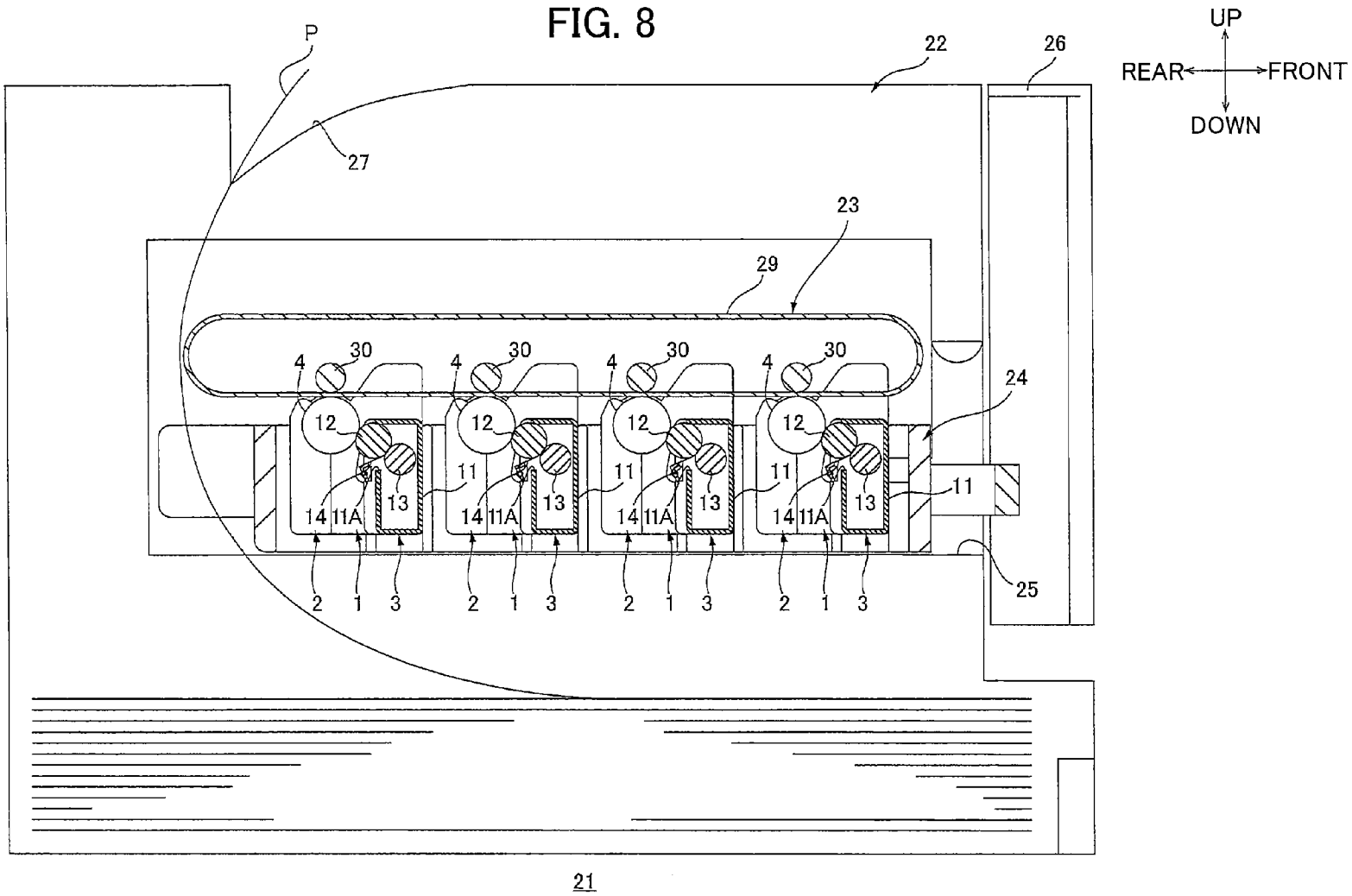
FIG. 8 is a schematic view conceptually illustrating a structure of an image-forming apparatus configured to receive the process cartridge according to the first embodiment.

As shown in FIGS. 1 and 8, the developing unit 3 is provided in a front end portion of the process cartridge 1 such that the developing unit 3 is positioned diagonally downward and forward of the photosensitive drum 4. The developing unit 3 is interposed between the right side plate 5R and left side plate 5L.

The developing unit 3 includes a frame 11 having an opening 11A formed therein, a developing roller 12, a supply roller 13, a thickness-regulating blade 14, a developing-roller joint 15, and a power-receiving member 16. The developing roller 12, the supply roller 13, and the thickness-regulating blade 14 are examples of a developing member. The developing-roller joint 15 is an example of a developing joint.

The developing unit 3 can pivotally move relative to the drum unit 2 between a first position (see FIG. 4A) at which the developing roller 12 is in contact with the photosensitive drum 4, and a second position (see FIG. 4B) at which the developing roller 12 is separated from the photosensitive drum 4. More specifically, the developing unit 3 is supported by the drum unit 2 such that the developing unit 3 is pivotally movable between the first position and the second position about a pivot axis A2 aligned with the left-right direction.

The frame 11 has a box-shape elongated in the left-right direction. The frame 11 is positioned between the left side plate 5L and right side plate 5R of the drum unit 2. The frame 11 serves to accommodate toner therein. As shown in FIG. 7, the frame 11 has a left surface (outer surface) that contacts a right surface S (inner surface) of the left side plate 5L, thereby fixing the position of the developing unit 3 in the left-right direction. In other words, the right surface S of the left side plate 5L of the drum unit 2 functions to provide positioning of the developing unit 3 relative to the drum unit 2 in the left-right direction.

As shown in FIGS. 1 and 8, the opening 11A is formed in an upper rear end of the frame 11. The opening 11A is elongated in the left-right direction and penetrates a rear wall of the frame 11 in the front-rear direction.

Figure 5:
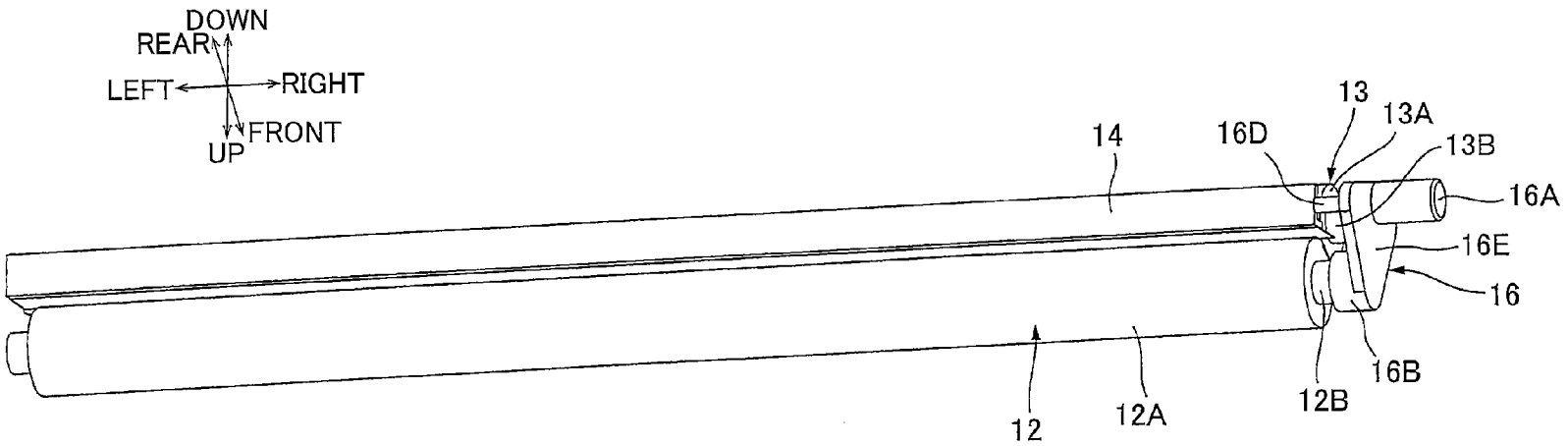
FIG. 5 is a perspective view illustrating an electrical connection among a connecting terminal, a developing roller, a supply roller and a thickness-regulating blade provided in the process cartridge according to the first embodiment.

As shown in FIGS. 1 and 5, the developing roller 12 is positioned frontward and downward of the photosensitive drum 4. The developing roller 12 is rotatably provided inside the opening 11A. The developing roller 12 is configured to supply toner to the photosensitive drum 4. The developing roller 12 has a circular column shape elongated in the left-right direction. The developing roller 12 includes a roller part 12A, and a shaft 12B.

The roller part 12A constitutes an outer radial portion of the developing roller 12. The roller part 12A has a cylindrical shape and is elongated in the left-right direction. The roller part 12A is formed of an electrically conductive rubber. The roller part 12A contacts a lower-front portion of the peripheral surface of the photosensitive drum 4. That is, an outer circumferential surface of the roller part 12A defines a peripheral surface of the developing roller 12.

The shaft 12B constitutes an inner radial portion of the developing roller 12. The shaft 12B has a columnar shape and is elongated in the left-right direction. The shaft 12B is formed of a metal such as steel or stainless steel. The shaft 12B is inserted into an interior of the roller part 12A, with an outer circumferential surface of the shaft 12B contacting an inner circumferential surface of the roller part 12A. The shaft 12B has a left end that protrudes farther leftward than a left edge of the roller part 12A. The left end of the shaft 12B is rotatably supported by a left wall of the frame 11. The shaft 12B has a right end that protrudes farther rightward than a right edge of the roller part 12A. Similarly, the right end of the shaft 12B is rotatably supported in a first bearing 16B (described later) of the power-receiving member 16.

As shown in FIGS. 5 and 8, the supply roller 13 is positioned on the lower-front side of the developing roller 12. The supply roller 13 is configured to supply toner to the developing roller 12. The supply roller 13 has a columnar shape and is elongated in the left-right direction. The supply roller 13 includes a roller part 13A, and a shaft 13B.

The roller part 13A constitutes an outer radial portion of the supply roller 13. The roller part 13A has a cylindrical shape elongated in the left-right direction. The roller part 13A is formed of an electrically conductive sponge. The roller part 13A contacts a lower-front portion of the circumferential surface of the roller part 12A constituting the developing roller 12.

The shaft 13B constitutes an inner radial portion of the supply roller 13. The shaft 13B has a columnar shape and is elongated in the left-right direction. The shaft 13B is formed of a metal such as steel or stainless steel. The shaft 13B is inserted into an interior of the roller part 13A, with an outer circumferential surface of the shaft 13B contacting an inner circumferential surface of the roller part 13A. The shaft 13B has a left end that protrudes farther leftward than a left edge of the roller part 13A, and a right end that protrudes farther rightward than a right edge of the roller part 13A. The left end of the shaft 13B is rotatably supported in the left wall of the frame 11, while the right end of the shaft 13B is rotatably supported in a second bearing 16C (described later; see FIG. 7) of the power-receiving member 16.

The thickness-regulating blade 14 is positioned below the developing roller 12. The thickness-regulating blade 14 has an L-shape in a side view and is elongated in the left-right direction. The thickness-regulating blade 14 is supported on the rear wall of the frame 11. The thickness-regulating blade 14 contacts a bottom surface on the roller part 12A of the developing roller 12 and is configured to regulate the thickness of a toner layer carried on the peripheral surface of the developing roller 12.

Figure 6:
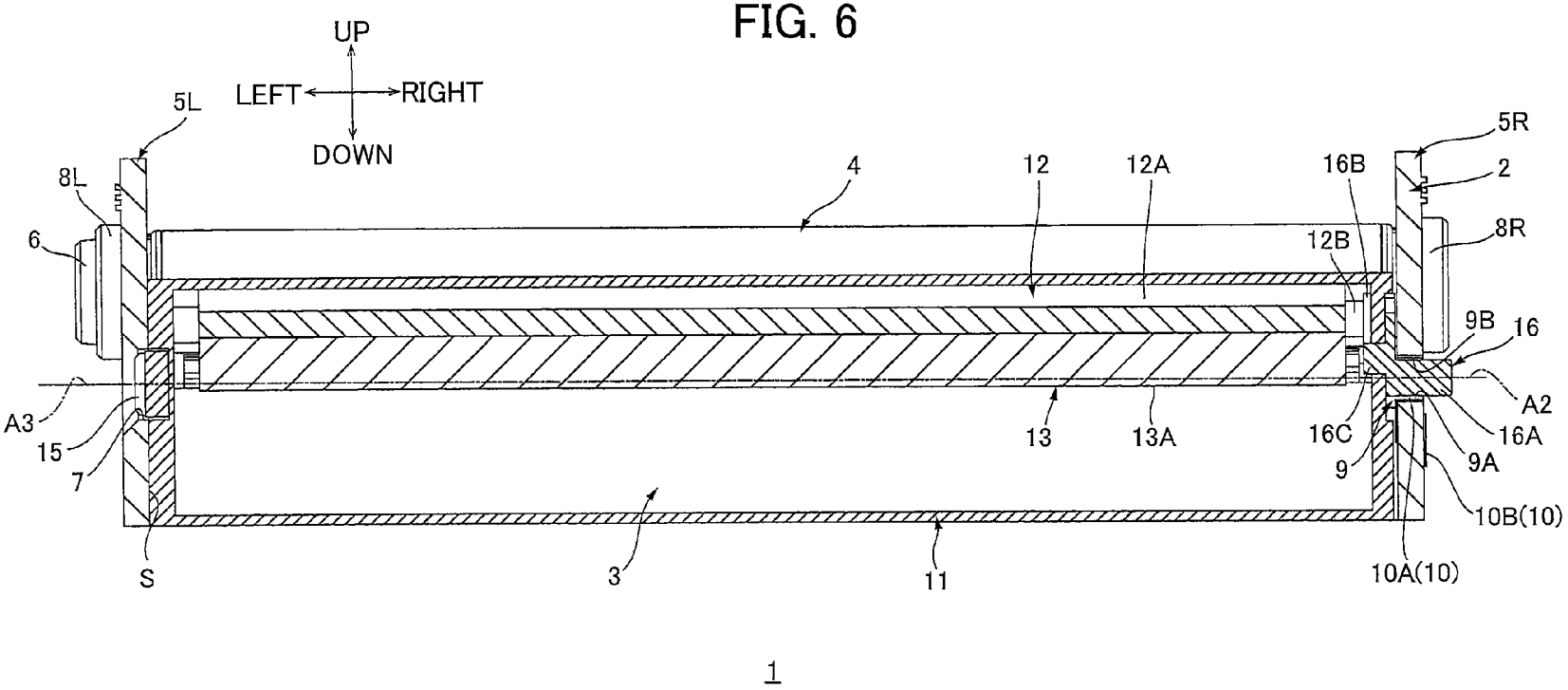
FIG. 6 is a cross-sectional view of the process cartridge of FIG. 3A taken along a plane B-B shown in FIG. 3A.

As shown in FIGS. 3B and 6, the developing-roller joint 15 is rotatably supported in the left wall of the frame 11. The developing-roller joint 15 has a columnar shape and is elongated in the left-right direction. The developing-roller joint 15 has a left end that is rotatably fitted into the hole 7 formed in the left side plate 5L. Accordingly, a left end portion of the developing unit 3 is coupled to the drum unit 2 by the left side plate 5L. The developing-roller joint 15 defines a rotational axis A3 that is coaxial with (coincident with) the pivot axis A2 of the developing unit 3. The developing-roller joint 15 is connected to the shaft 12B of the developing roller 12 and the shaft 13B of the supply roller 13 through a gear assembly (not shown). Further, when the process cartridge 1 is mounted in the image-forming apparatus 21 described later (see FIG. 8), the developing-roller joint 15 is configured to be coupled with a fourth coupling 49 provided in the image-forming apparatus 21 indicated by phantom lines in FIG. 1, and is capable of rotating together with the fourth coupling 49. In other words, the developing-roller joint 15 is configured to receive a drive force from the fourth coupling 49 and to transmit this drive force to the developing roller 12 and supply roller 13.

Figure 4A:
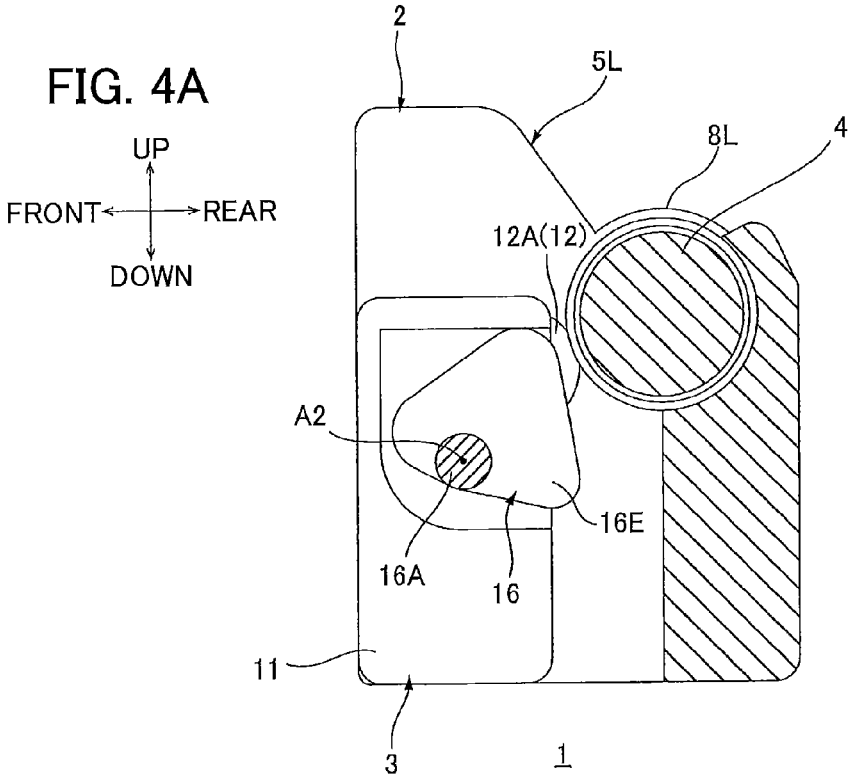
FIG. 4A is a cross-sectional view of the process cartridge of FIG. 2 taken along a plane A-A shown in FIG. 2 and showing a state where a developing unit is at a first position.
Figure 4B:
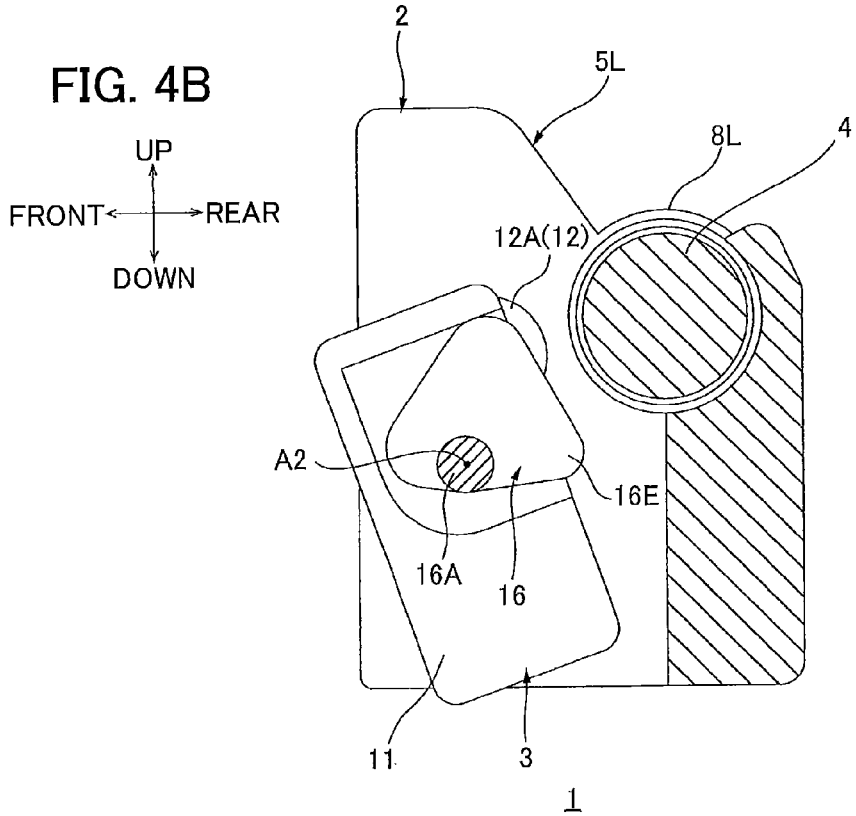
FIG. 4B is a cross-sectional view of the process cartridge of FIG. 2 taken along the plane A-A shown in FIG. 2 and showing a state where the developing unit is at a second position.

As shown in FIGS. 4A, 4B, and 5, the power-receiving member 16 is supported on a right wall of the frame 11. The power-receiving member 16 is formed of an electrically conductive resin. The power-receiving member 16 includes a base plate 16E, the supported part 16A (as an example of an electrical terminal), the first bearing 16B, the second bearing 16C, and a contact part 16D.

The base plate 16E has a triangular shape in a side view and expands in front-rear and vertical directions.

As shown in FIGS. 3A, 4A, and 5, the supported part 16A is positioned on a lower-front end portion of the power-receiving member 16. The supported part 16A is positioned on a right surface of the base plate 16E and protrudes rightward therefrom. The supported part 16A is positioned to be aligned with the pivot axis A2 of the developing unit 3 (see FIG. 6). The supported part 16A has a circular columnar shape elongated in the left-right direction. The supported part 16A has an outer diameter D that is equivalent to the inside dimension L2 of the hole 9 in the second direction and that is shorter than the inside dimension L1 of the hole 9 in the first direction. The supported part 16A is rotatably fitted in the hole 9. Hence, the right side plate 5R rotatably supports the supported part 16A. Through this structure, the right end portion of the developing unit 3 is coupled to the drum unit 2 via the right side plate 5R. The supported part 16A has a circumferential surface on whose lower-rear portion the supported part 16A contacts the first contact part 10A of the connecting member 10, whereby the supported part 16A is electrically connected to the first contact part 10A.

As shown in FIG. 5, the first bearing 16B is positioned on a top end portion of the power-receiving member 16. The first bearing 16B is positioned on a left surface of the base plate 16E and protrudes leftward therefrom. The first bearing 16B has a cylindrical shape that is elongated in the left-right direction. The first bearing 16B penetrates the right wall of the frame 11 and is fitted around the right end of the shaft 12B in the developing roller 12. With this configuration, the supported part 16A is electrically connected to the right end of the shaft 12B through the base plate 16E and first bearing 16B. Further, the first bearing 16B rotatably supports the developing roller 12.

As shown in FIGS. 6 and 7, the second bearing 16C is positioned on a lower-front portion of the power-receiving member 16. The second bearing 16C is positioned on the left surface of the base plate 16E and protrudes leftward therefrom. The second bearing 16C has a cylindrical shape that is elongated in the left-right direction. The second bearing 16C penetrates the right wall of the frame 11 and is fitted around the right end of the shaft 13B in the supply roller 13. With this configuration, the supported part 16A is electrically connected to the right end of the shaft 13B through the base plate 16E and second bearing 16C. Further, the second bearing 16C rotatably supports the supply roller 13.

As shown in FIG. 5, the contact part 16D is positioned on a lower-rear portion of the power-receiving member 16. The contact part 16D is provided on the left surface of the base plate 16E. The contact part 16D has a columnar shape that is elongated in the left-right direction. The contact part 16D penetrates the right wall of the frame 11 and contacts a right end of the thickness-regulating blade 14. With this configuration, the supported part 16A is electrically connected to the right end of the thickness-regulating blade 14 through the base plate 16E and contact part 16D.

2. Modes of Using the Process Cartridge

Next, a mode of using the process cartridge 1 will be described. As shown in FIG. 8, the process cartridge 1 is used while mounted in a casing 22 of the image-forming apparatus 21.

(1) Image-Forming Apparatus

The image-forming apparatus 21 is an intermediate transfer type color laser printer. The image-forming apparatus 21 includes the casing 22, a drawer 24, and a belt unit 23.

The casing 22 has a box-like shape. The casing 22 includes an opening 25, a cover 26, a discharge tray 27, and four body-side electrical contacts 28 as an example of an electrical contact (see FIG. 7).

The opening 25 is formed in a front end portion (more specifically in a front wall) of the casing 22. The opening 25 penetrates the front wall of the casing 22 in the front-rear direction. The opening 25 allows passage of the process cartridges 1 and the drawer 24 into and out of the casing 22.

The cover 26 is provided on the front end portion of the casing 22. The cover 26 has a plate-like shape that is elongated vertically. The cover 26 can open and close over the opening 25.

The discharge tray 27 is provided on a top surface of the casing 22. The discharge tray 27 is recessed downward into the top surface of the casing 22.

As shown in FIG. 7, the body-side electrical contacts 28 are positioned on an inner surface of a right wall constituting the casing 22. The body-side electrical contacts 28 have a columnar shape that is elongated in the left-right direction. The body-side electrical contacts 28 have left ends that are rounded into an arc shape. There are four body-side electrical contacts 28 corresponding to the four process cartridges 1 mountable in the casing 22.

As shown in FIG. 8, the drawer 24 is disposed in a general vertical center of the casing 22. The drawer 24 can be pulled out of the casing 22 through the opening 25. Four of the process cartridges 1 are supported in the drawer 24 at intervals in the front-rear direction. The process cartridges 1 are detachably mountable in the drawer 24.

The belt unit 23 is positioned above the drawer 24 in the casing 22. The belt unit 23 includes a belt 29, and four transfer rollers 30.

The belt 29 is an endless belt that is stretched in the front-rear direction. The belt 29 has a lower portion that can contact top surfaces of the four photosensitive drums 4. The belt 29 is configured to circularly move so that its lower portion moves from front-to-rear. A secondary transfer roller (not shown) is disposed so as to contact a rear end portion of the belt 29.

The four transfer rollers 30 are disposed in an internal space defined by an inner peripheral surface of the belt 29 at positions spaced away from one another in the front-rear direction. The transfer rollers 30 are positioned above corresponding photosensitive drums 4 such that the belt 29 is interposed between each transfer roller 30 and the corresponding photosensitive drum 4. The transfer rollers 30 have a columnar shape that is elongated in the left-right direction.

While not shown in the drawings, the image-forming apparatus 21 also includes a scanner for irradiating laser beams onto the photosensitive drums 4 based on image data, and a fixing device for fixing toner images on sheets P by applying heat and pressure to the sheets P after toner images have been transferred thereon.

(2) Power Supply to the Process Cartridge

Each body-side electrical contact 28 contacts the second contact part 10B of the corresponding connecting member 10 when the process cartridge 1 is mounted in the casing 22, as illustrated in FIG. 7. In this state, the body-side electrical contact 28 is electrically connected to the second contact part 10B.

Note that the positions of the drum units 2 in the front-rear direction are set by positioning parts (not shown) when the process cartridges 1 are mounted in the casing 22, as shown in FIG. 8. Further, the drum units 2 are urged upward by pressing members (not shown) so that the corresponding photosensitive drums 4 contact the belt 29. Through this configuration, the drum units 2 are fixed in their front-rear and vertical positions. By fixing the positions of the drum units 2 in this way, the second contact parts 10B of the connecting members 10 provided in the corresponding drum units 2 are also fixed in their front-rear and vertical positions. Hence, the body-side electrical contacts 28 contact the second contact parts 10B that are fixed in position.

When the image-forming apparatus 21 supplies power to the connecting members 10 via the body-side electrical contacts 28, the power is supplied to the supported parts 16A of the corresponding power-receiving members 16 via the first contact parts 10A of the connecting members 10, as illustrated in the structures of FIGS. 5 and 7. From the supported parts 16A of the connecting members 10, the power is supplied to the shafts 12B of the developing rollers 12 via the first bearings 16B of the power-receiving members 16, to the shafts 13B of the supply rollers 13 via the second bearings 16C of the power-receiving members 16, and to the thickness-regulating blades 14 via the contact parts 16D of the power-receiving members 16.

(3) Image-Forming Operation

Referring to FIG. 8, at the beginning of an image-forming operation performed by the image-forming apparatus 21, the chargers (not shown) apply a uniform charge to the surfaces of the corresponding photosensitive drums 4. Subsequently, the scanner (not shown) irradiates laser beams onto the surfaces of the photosensitive drums 4, thereby forming electrostatic latent images on the photosensitive drums 4 based on image data.

Next, the developing rollers 12 supply toner to the electrostatic latent images formed on the surfaces of the corresponding photosensitive drums 4 to produce toner images on the surfaces of the photosensitive drums 4. The toner images carried on the surfaces of the photosensitive drums 4 are subsequently transferred onto the belt 29.

In the meantime, sheets P accommodated in a bottom section of the casing 22 are conveyed one at a time between the belt 29 and the secondary transfer roller (not shown) at a prescribed timing. The toner images carried on the belt 29 are then transferred onto the sheets P when the sheets P pass between the belt 29 and the secondary transfer roller.

Next, the fixing device (not shown) applies heat and pressure to the sheets P to thermally fix the toner images to the sheets P. Thereafter, the sheets P are discharged onto the discharge tray 27.

When printing a color image with the image-forming apparatus 21, the developing units 3 in all process cartridges 1 are placed in the first position shown in FIG. 4A.

However, when printing a monochrome image on the image-forming apparatus 21, only the developing unit 3 provided in the process cartridge 1 that accommodates black toner is placed in the first position shown in FIG. 4A. The developing units 3 in all other process cartridges 1 not accommodating black toner are placed in the second position shown in FIG. 4B.

As shown in FIGS. 4A and 4B, the developing unit 3 is configured to pivot about the pivot axis A2 when moving between the first position and second position.

3. Operational Advantages of the First Embodiment (1) With the process cartridge 1 of the embodiment described above, the supported part 16A is provided on the pivot axis A2 of the developing unit 3 about which the developing unit 3 pivots relative to the drum unit 2, as shown in FIGS. 4A and 4B. Therefore, there is little movement of the supported part 16A when the developing unit 3 pivots. By reducing the amount of movement of the supported part 16A when the developing unit 3 pivots, this construction can suppress wear of the supported part 16A. As a result, power can be supplied stably to at least one of the developing roller 12, supply roller 13, and thickness-regulating blade 14.

(2) As shown in FIG. 5, the power-receiving member 16 is integrally provided with the first bearing 16B electrically connected to the developing roller 12, the second bearing 16C electrically connected to the supply roller 13, and the contact part 16D electrically connected to the thickness-regulating blade 14. Hence, through a simple construction, the process cartridge 1 can supply an equal amount of power to the developing roller 12, supply roller 13, and thickness-regulating blade 14.

(3) As shown in FIGS. 3A and 7, the drum unit 2 includes the first contact part 10A that is connected to the supported part 16A, and the second contact part 10B that can be electrically connected to the body-side electrical contact 28. Accordingly, the second contact part 10B capable of being electrically connected to the body-side electrical contact 28 can be freely arranged in the drum unit 2. This ensures better freedom of design for the image-forming apparatus 21 and the process cartridge 1.

(4) As shown in FIG. 7, the connecting member 10 is disposed in the right side plate 5R. More specifically, the second contact part 10B of the connecting member 10 is disposed to extend along the right surface (outer surface in the left-right direction) of the right side plate 5R. Hence, the second contact part 10B of the connecting member 10 can easily be accessed in the left-right direction (direction of the rotational axis) from the outside of the process cartridge 1.

(5) As shown in FIG. 3A, the second contact part 10B is separated from the supported part 16A in a direction diagonally downward and rearward therefrom (in the second direction). Accordingly, the second contact part 10B can be freely arranged apart from the supported part 16A.

(6) As shown in FIG. 3A, the right side plate 5R has the hole 9 formed therein whose length (inside dimension L1) in the first direction (direction extending from the lower front to the upper rear) is greater than the outer diameter D of the supported part 16A, and whose length (inside dimension L2) in the second direction orthogonal to the first direction (direction extending from the upper front to the lower rear) is equivalent to the outer diameter D of the supported part 16A. This configuration not only allows the supported part 16A to move in the first direction, but also ensures reliably contact between the supported part 16A and the first contact part 10A in the second direction. This arrangement ensures that the supported part 16A will reliably contact the first contact part 10A while enabling the developing unit 3 to pivot smoothly relative to the drum unit 2.

(7) As shown in FIG. 6, the rotational axis A3 of the developing-roller joint 15 is arranged coaxially with the pivot axis A2 of the developing unit 3. Accordingly, the developing unit 3 can be pivoted relative to the drum unit 2 while a drive force is being inputted into the developing-roller joint 15.

(8) As shown in FIG. 6, the inner surface of the left side plate 5L of the drum unit 2 serves to set the position of the developing unit 3 in the left-right direction by contacting the developing unit 3. Hence, the left side plate 5L that supports the developing unit 3 can be used also to determine the left-right position of the developing unit 3. Hence, the developing unit 3 can be positioned in the left-right direction through a simple structure.

(9) As shown in FIG. 1, the right side plate 5R rotatably supports the right end of the photosensitive drum 4. Hence, both the photosensitive drum 4 and developing unit 3 can be supported by the right side plate 5R. Thus, precision in the relative layout of the photosensitive drum 4 and developing unit 3 can be ensured with the right side plate 5R.

Second Embodiment

Next, a process cartridge 50 according to a second embodiment will be described with reference to FIGS. 9A and 9B, wherein like parts and components are designated with the same reference numerals as the first embodiment to avoid duplicating description.

1. Structure According to the Second Embodiment

As shown in FIG. 5, the power-receiving member 16 in the first embodiment is integrally provided with the first bearing 16B, second bearing 16C, and contact part 16D for supplying the same magnitude of power to the developing roller 12, supply roller 13, and thickness-regulating blade 14.

Figure 9A:
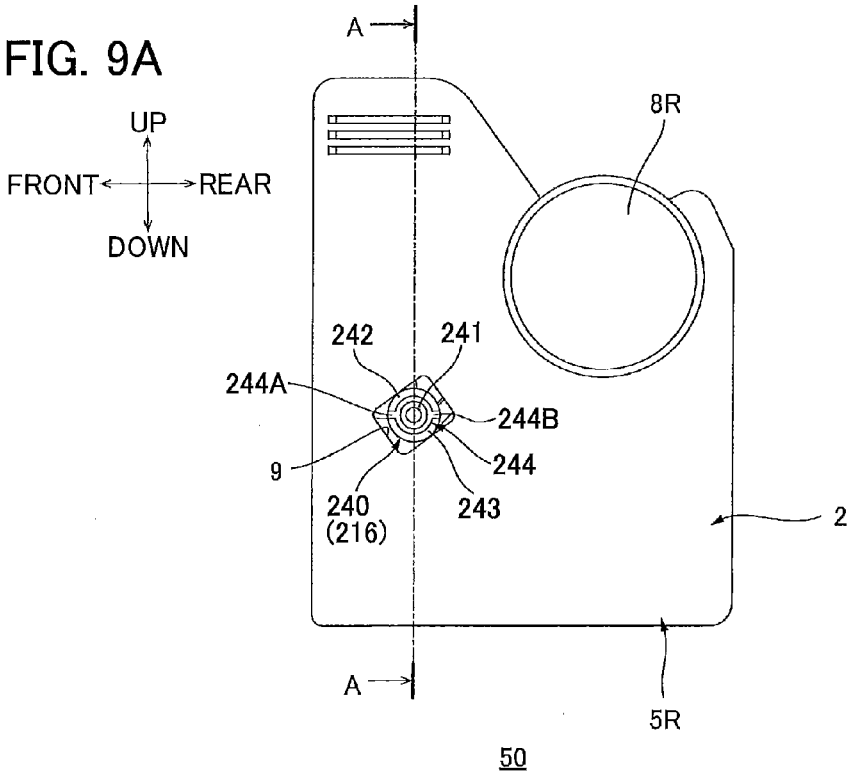
FIG. 9A is a right side view of a process cartridge according to a second embodiment.
Figure 9B:
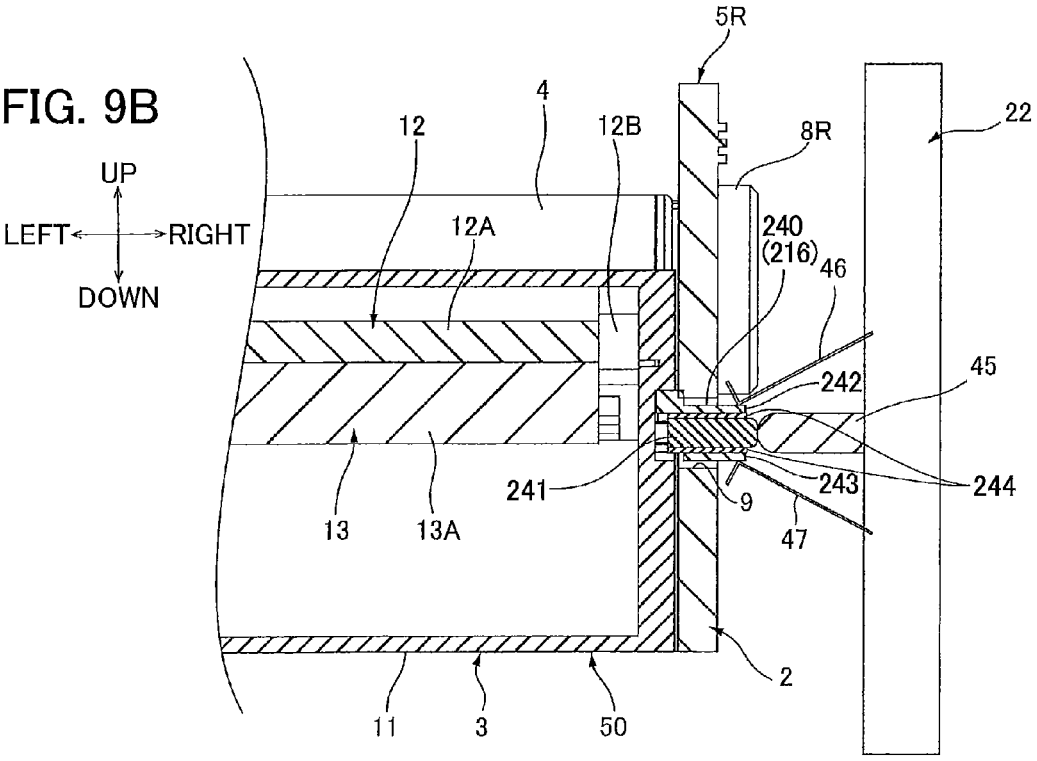
FIG. 9B is a cross-sectional view of the process cartridge of FIG. 9A taken along a plane A-A shown in FIG. 9A.

As shown in FIGS. 9A and 9B, a power-receiving member 216 according to the second embodiment is separately provided with a first connection terminal 241 electrically connected to the developing roller 12, a second connection terminal 242 electrically connected to the supply roller 13, and a third connection terminal 243 electrically connected to the thickness-regulating blade 14. The first connection terminal 241, second connection terminal 242, and third connection terminal 243 are insulated from one another by an insulating part 244. The first connection terminal 241 is an example of a first terminal, the second connection terminal 242 is an example of a second terminal, and the third connection terminal 243 is an example of a third terminal.

More specifically, the power-receiving member 216 includes a supported part 240. The supported part 240 is a protrusion having a circular column shape that is elongated in the left-right direction. The supported part 240 is provided with the first connection terminal 241, insulating part 244, second connection terminal 242, and third connection terminal 243.

The first connection terminal 241 constitutes an inner radial portion of the supported part 240 and is elongated in the left-right direction. The first connection terminal 241 is formed of a metal, such as copper. The first connection terminal 241 has a right end that protrudes farther rightward than a right end of the insulating part 244. That is, the first connection terminal 241 is positioned on a right end face of the supported part 240 when viewed from the right. In other words, the first connection terminal 241 constitutes part of the right end face of the supported part 240.

The insulating part 244 is positioned radially outside of the first connection terminal 241. The insulating part 244 has a cylindrical shape that is elongated in the left-right direction. The insulating part 244 covers an outer circumferential surface of the first connection terminal 241. The insulating part 244 includes a first rib 244A, and a second rib 244B.

The first rib 244A protrudes forward from a front edge of the insulating part 244. The first rib 244A is elongated in the left-right direction.

The second rib 244B is positioned on a side opposite the first rib 244A with respect to the first connection terminal 241 in the front-rear direction. That is, the second rib 244B protrudes rearward from a rear edge of the insulating part 244 and is elongated in the left-right direction.

The second connection terminal 242 constitutes an upper circumferential surface of the supported part 240. That is, the second connection terminal 242 possesses the upper half of the circumferential surface constituting the supported part 240. The second connection terminal 242 is positioned on the insulating part 244. The second connection terminal 242 has a semicylindrical shape that follows an upper circumferential surface of the insulating part 244 and is elongated in the left-right direction. The second connection terminal 242 has a front end that is provided on the first rib 244A, and a rear end that is provided on the second rib 244B.

The third connection terminal 243 constitutes a lower circumferential surface of the supported part 240. That is, the third connection terminal 243 possesses the lower half of the circumferential surface constituting the supported part 240. The third connection terminal 243 is positioned beneath the insulating part 244. The third connection terminal 243 has a semicylindrical shape that follows a lower circumferential surface of the insulating part 244 and is elongated in the left-right direction. The third connection terminal 243 has a front end that is positioned beneath the first rib 244A, and a rear end that is positioned beneath the second rib 244B.

In the second embodiment, the casing 22 of the image-forming apparatus 21 is provided with a first body-side electrical contact 45 for contacting the first connection terminal 241, a second body-side electrical contact 46 for contacting the second connection terminal 242, and a third body-side electrical contact 47 for contacting the third connection terminal 243.

The first body-side electrical contact 45 is provided on the inner surface of the right wall of the casing 22. The first body-side electrical contact 45 has a circular column shape that is elongated in the left-right direction. The first body-side electrical contact 45 has a left end that is rounded into an arc shape. When the process cartridge 50 is mounted in the casing 22, the left end of the first body-side electrical contact 45 is in contact with a right surface of the first connection terminal 241, forming an electrical connection with the first connection terminal 241.

The second body-side electrical contact 46 is positioned above the first body-side electrical contact 45. The second body-side electrical contact 46 has a plate shape that is elongated in the left-right direction. When the process cartridge 50 is mounted in the casing 22, a left end portion of the second body-side electrical contact 46 is in contact with the upper circumferential surface of the second connection terminal 242, thereby establishing an electrical connection with the second connection terminal 242.

The third body-side electrical contact 47 is positioned below the first body-side electrical contact 45. The third body-side electrical contact 47 has a plate shape that is elongated in the left-right direction. When the process cartridge 50 is mounted in the casing 22, a left end portion of the third body-side electrical contact 47 is in contact with the lower circumferential surface of the third connection terminal 243, thereby establishing an electrical connection with the third connection terminal 243.

2. Operational Advantages of the Second Embodiment (1) With the process cartridge 50 of the second embodiment shown in FIGS. 9A and 9B, the supported part 240 has the first connection terminal 241 that is electrically connected to the developing roller 12, and the second connection terminal 242 that is electrically connected to the supply roller 13 and insulated from the first connection terminal 241. Accordingly, the process cartridge 50 can apply different biases to the developing roller 12 and supply roller 13 while ensuring a stable supply of power to the same.

(2) As shown in FIG. 9A, the first connection terminal 241 is positioned on the right surface of the supported part 240 in a right side view. Further, the second connection terminal 242 constitutes the upper circumferential surface of the supported part 240. The insulating part 244 is interposed between the first connection terminal 241 and second connection terminal 242. Hence, the first connection terminal 241 and second connection terminal 242 can be reliably insulated from each other through a simple construction.

(3) As shown in FIGS. 9A and 9B, the supported part 240 is a circular column. Hence, the developing unit 3 can be smoothly pivoted relative to the drum unit 2 owing to the circumferential surface of the supported part 240.

(4) As shown in FIGS. 9A and 9B, the supported part 240 includes the third connection terminal 243 that is electrically connected to the thickness-regulating blade 14 and insulated from both the first connection terminal 241 and second connection terminal 242. Hence, the process cartridge 50 can apply a different bias to the thickness-regulating blade 14 from the biases applied to the developing roller 12 and supply roller 13, while ensuring a stable supply of power to the thickness-regulating blade 14.

(5) As shown in FIG. 9A, the third connection terminal 243 constitutes the lower circumferential surface of the supported part 240. The insulating part 244 is interposed between the third connection terminal 243 and the first connection terminal 241, and between the third connection terminal 243 and second connection terminal 242. Hence, the third connection terminal 243 can be reliably insulated from the first connection terminal 241 and second connection terminal 242 through a simple construction.

(6) The process cartridge 50 according to the second embodiment can obtain the same operational advantages described in the first embodiment.

Variations of the Embodiments

As a variation of the second embodiment, the first connection terminal 241 and second connection terminal 242 may be configured integrally, while only the third connection terminal 243 may be provided separately from the first connection terminal 241 and second connection terminal 242.

While the description has been made in detail with reference to specific embodiments thereof, it would be apparent to those skilled in the art that various changes and modifications may be made therein without departing from the scope of the above described embodiments.

What is claimed is:

1. A process cartridge comprising:

a first unit including a first side plate, a second side plate and a photosensitive drum; and a second unit pivotally movable relative to the first unit about a pivot axis between a first position and a second position, the second unit comprising:

a developing member; and an electrical terminal for supplying power to the developing member, the electrical terminal being rotatably supported by the first side plate and positioned on the pivot axis.

2. The process cartridge as claimed in claim 1, wherein the electrical terminal is a protrusion.

3. The process cartridge as claimed in claim 2, wherein the protrusion has a circular columnar shape.

4. The process cartridge as claimed in claim 1, wherein the first unit further comprises a connection member configured to electrically connect the electrical terminal to an electrical contact of an image-forming apparatus when the process cartridge is mounted in the image-forming apparatus, the connection member including a first contact in contact with the electrical terminal and a second contact configured to contact the electrical contact when the process cartridge is mounted in the image-forming apparatus.

5. The process cartridge as claimed in claim 4, wherein the connection member is provided on the first side plate.

6. The process cartridge as claimed in claim 4, wherein the second contact of the connection member is positioned to be spaced apart from the electrical terminal in a direction perpendicular to the pivot axis.

7. The process cartridge as claimed in claim 4, wherein the electrical terminal is a protrusion.

8. The process cartridge as claimed in claim 7, wherein the protrusion has a circular columnar shape.

9. The process cartridge as claimed in claim 7, wherein the first side plate is formed with a hole for receiving the electrical terminal.

10. The process cartridge as claimed in claim 9, wherein the hole is defined by a peripheral surface, the first contact being interposed between the electrical terminal and the peripheral surface.

11. The process cartridge as claimed in claim 1, wherein the second unit further includes a developing joint configured to receive a drive force for driving the developing member, the developing joint defining a rotational axis about which the developing joint is rotatable, the rotational axis being coincident with the pivot axis.

12. The process cartridge as claimed in claim 1, wherein the second side plate opposes and contacts the second unit in a particular direction parallel to the pivot axis, the second side plate providing positioning of the second unit relative to the first unit in the particular direction.

13. The process cartridge as claimed in claim 1, wherein the first side plate rotatably supports the photosensitive drum.

14. The process cartridge as claimed in claim 1, wherein the developing member comprises a developing roller, the developing roller being in contact with the photosensitive drum when the second unit is at the first position, the developing roller being separated from the photosensitive drum when the second unit is at the second position.

15. The process cartridge as claimed in claim 14, wherein the developing member further comprises a supply roller configured to supply toner to the developing roller.

16. The process cartridge as claimed in claim 14, wherein the developing member further comprises a thickness-regulating blade configured to regulate a thickness of toner on the developing roller.

17. The process cartridge as claimed in claim 14, wherein the developing member further comprises a supply roller configured to supply toner to the developing roller, and wherein the second unit further comprises:

a first bearing supporting the developing roller and electrically connected to the developing roller; and a second bearing supporting the supply roller and electrically connected to the supply roller, the first bearing and the second bearing being electrically connected to the electrical terminal.

18. The process cartridge as claimed in claim 17, wherein the developing member further comprises a thickness-regulating blade configured to regulate a thickness of the toner on the developing roller, the electrical terminal being electrically connected to the thickness-regulating blade.

19. The process cartridge as claimed in claim 1, wherein the electrical terminal comprises:

a first terminal electrically connected to a developing roller, the developing roller being a developing member;

a second terminal electrically connected to a supply roller, the supply roller being configured to supply toner to the developing roller; and an insulating part disposed between the first terminal and the second terminal and providing electrical insulation between the first terminal and the second terminal.

20. The process cartridge as claimed in claim 19, wherein the electrical terminal is a protrusion extending parallel to the pivot axis, the protrusion having an outer circumferential surface extending parallel to the pivot axis and an end face connected to the outer circumferential surface; and wherein the first terminal constitutes the end face and the second terminal constitutes at least part of the outer circumferential surface.

21. The process cartridge as claimed in claim 20, wherein the protrusion has a circular columnar shape.

22. The process cartridge as claimed in claim 20, wherein the electrical terminal further comprises a third terminal electrically connected to a thickness-regulating blade, the third terminal being electrically insulated from the first terminal and the second terminal.

23. The process cartridge as claimed in claim 22, wherein the third terminal constitutes at least part of the outer circumferential surface.

* * * * *